US006615410B1

(12) United States Patent
Gurrola

(10) Patent No.: US 6,615,410 B1
(45) Date of Patent: Sep. 9, 2003

(54) TOILET-VENTILATING DEVICE

(76) Inventor: Azael Gurrola, 12641 Gilded Sun St., El Paso, TX (US) 79936

( * ) Notice: Subject to any disclaimer, the term of this patent is extended or adjusted under 35 U.S.C. 154(b) by 0 days.

(21) Appl. No.: 10/207,266

(22) Filed: Jul. 30, 2002

(51) Int. Cl.[7] ..... E03D 9/052
(52) U.S. Cl. ..... 4/213; 4/217
(58) Field of Search ..... 4/213, 217

(56) References Cited

U.S. PATENT DOCUMENTS

| | | | | |
|---|---|---|---|---|
| 3,335,431 A | | 8/1967 | Coates | 4/213 |
| 3,585,651 A | | 6/1971 | Cox | 4/213 X |
| 3,824,637 A | | 7/1974 | Hunnicutt, Jr. | 4/213 |
| 3,857,119 A | * | 12/1974 | Hunnicutt, Jr. | 4/213 |
| 3,916,459 A | | 11/1975 | Ivancevic | 4/213 |
| 3,927,429 A | * | 12/1975 | Pearson | 4/213 |
| 4,168,553 A | | 9/1979 | Studer | 4/213 X |
| 4,175,293 A | | 11/1979 | Stephens et al. | 4/213 X |
| 4,617,687 A | * | 10/1986 | Wadsworth | 4/213 |
| 4,984,310 A | * | 1/1991 | Casale | 4/213 X |
| 5,416,930 A | * | 5/1995 | Waldner et al. | 4/213 |
| 5,857,222 A | * | 1/1999 | Keys | 4/213 |

FOREIGN PATENT DOCUMENTS

| | | |
|---|---|---|
| EP | 289696 | 11/1988 |
| SE | 189254 | 5/1958 |

* cited by examiner

*Primary Examiner*—Robert M. Fetsuga
(74) *Attorney, Agent, or Firm*—Stephen R. Greiner

(57) ABSTRACT

A toilet-ventilating device including a toilet seat having an internal passageway with a number of access ports. A hose extends from the toilet seat and communicates with the internal passageway. A deodorizer is connected to the hose. The deodorizer includes a housing having an inlet opening and an outlet opening. A blower is positioned within the housing for moving air from the internal passageway into the housing through the inlet opening and from the housing through the outlet opening. An air-permeable cartridge containing an aromatic substance is clipped to the exterior of the housing and covers the outlet opening.

7 Claims, 3 Drawing Sheets

TOILET-VENTILATING DEVICE

FIELD OF THE INVENTION

The present invention relates generally to products for ventilating toilets with electric-motor pumps.

BACKGROUND OF THE INVENTION

Many people are offended by the odors that escape from toilets. In response, devices have been proposed to remedy the problem. These devices generally vent odors from the room in which a toilet is located or emit a masking fragrance. Unfortunately, the known ventilating devices require a substantial effort in terms of time and effort to install as modifications to building structures are often required. Conventional air fresheners, however, are easy to install but are not effective in masking strong odors when they are needed most. Thus, a need exists for a toilet-ventilating device that is easy to install, convenient to use, effective in operation, and inexpensive to manufacture.

SUMMARY OF THE INVENTION

In light of the problems associated with the known products for eliminating offensive toilet odors, it is a principal object of the invention to provide a toilet-ventilating device that draws into itself malodorous air from a toilet bowl and passes that air through a deodorizer. The air emitted from the deodorizer carries a pleasant aroma. Having been treated at its source, full treatment of foul and malodorous air is assured.

It is another object of the invention to provide a toilet-ventilating device of the type described that is easy to install, requiring no special tools or instruction to accomplish the task. The toilet-ventilating device can be installed on toilets virtually anywhere and requires no modifications to the toilet or surrounding building structure to work effectively. The device can, therefore, be used by renters of commercial or residential space who lack the right to make building modifications.

It is a further object of the invention to provide a toilet-ventilating device that is portable and reusable. The device can be selectively energized by a user when needed thereby conserving electrical energy. The device is, thus, economical.

It is an object of the invention to provide improved elements and arrangements thereof in a toilet-ventilating device for the purposes described which is lightweight in construction, inexpensive to manufacture, and dependable in use.

Briefly, the device in accordance with this invention achieves the intended objects by featuring a toilet seat having an internal passageway with a number of access ports. A hose extends from the toilet seat and connects to the inlet opening of a deodorizer housing. The housing includes a pair of shoulders each having a number of outlet openings. A pair of guide rails project from the housing adjacent to the shoulders. A blower is positioned within the housing to move air from the toilet and through the seat, hose, and deodorizer housing. An air-permeable cartridge containing an aromatic substance is fastened to the exterior of the housing to cover the outlet openings and impart a pleasant aroma to malodorous air. The cartridge has legs adapted for sliding engagement with the housing between the shoulders and the guide rails.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
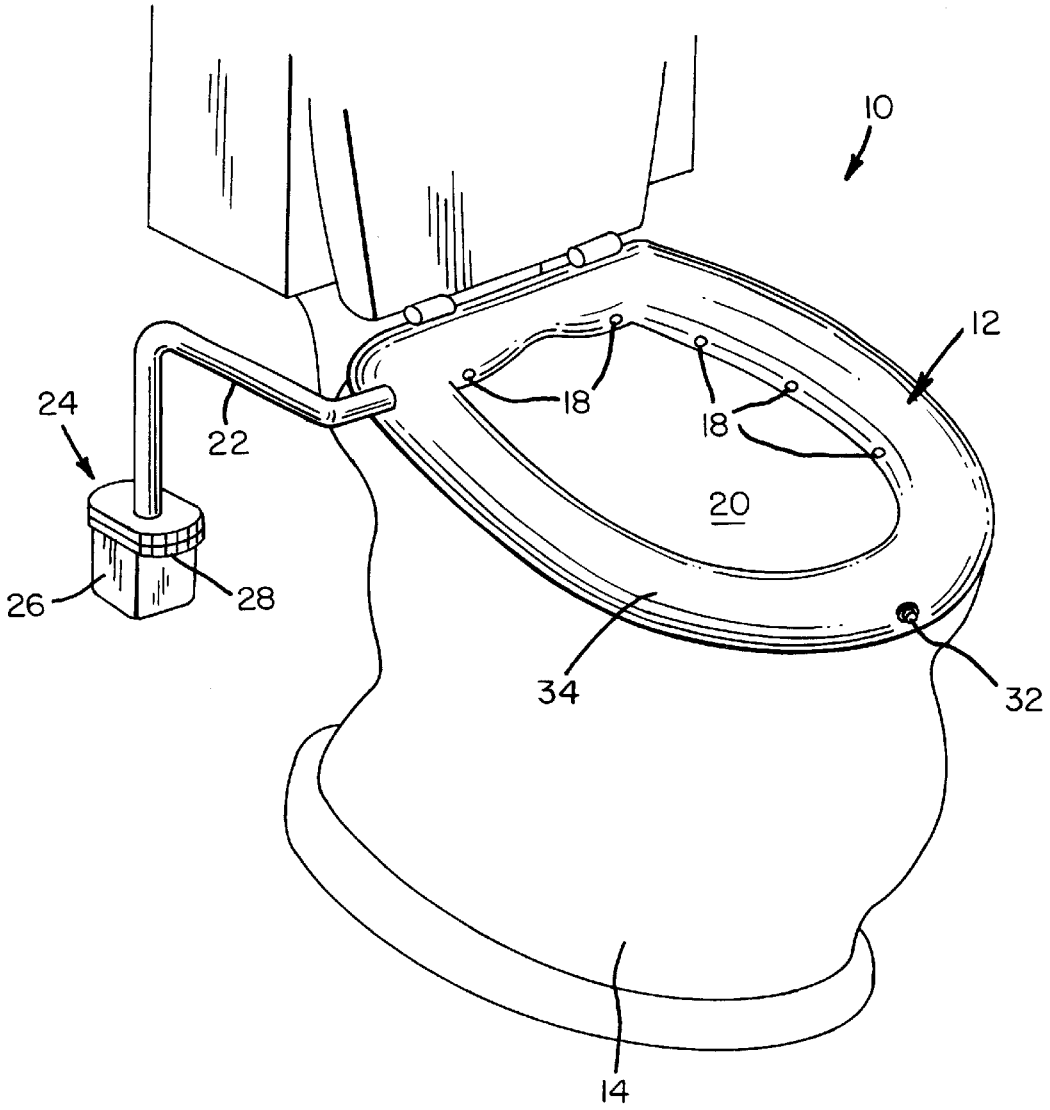
FIG. 1 is a perspective view of a toilet-ventilating device in accordance with the present invention.
Figure 2:
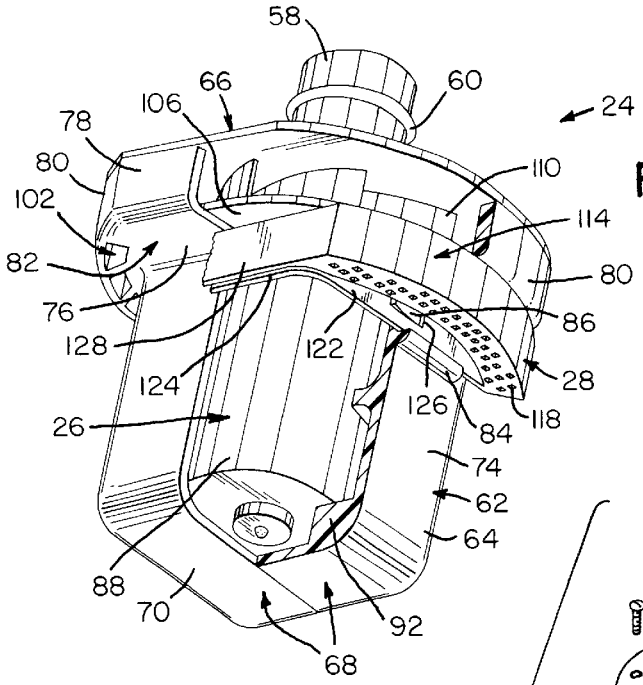
FIG. 2 is a perspective view of the deodorizer of the toilet-ventilating device with portions broken away to reveal details thereof.
Figure 3:
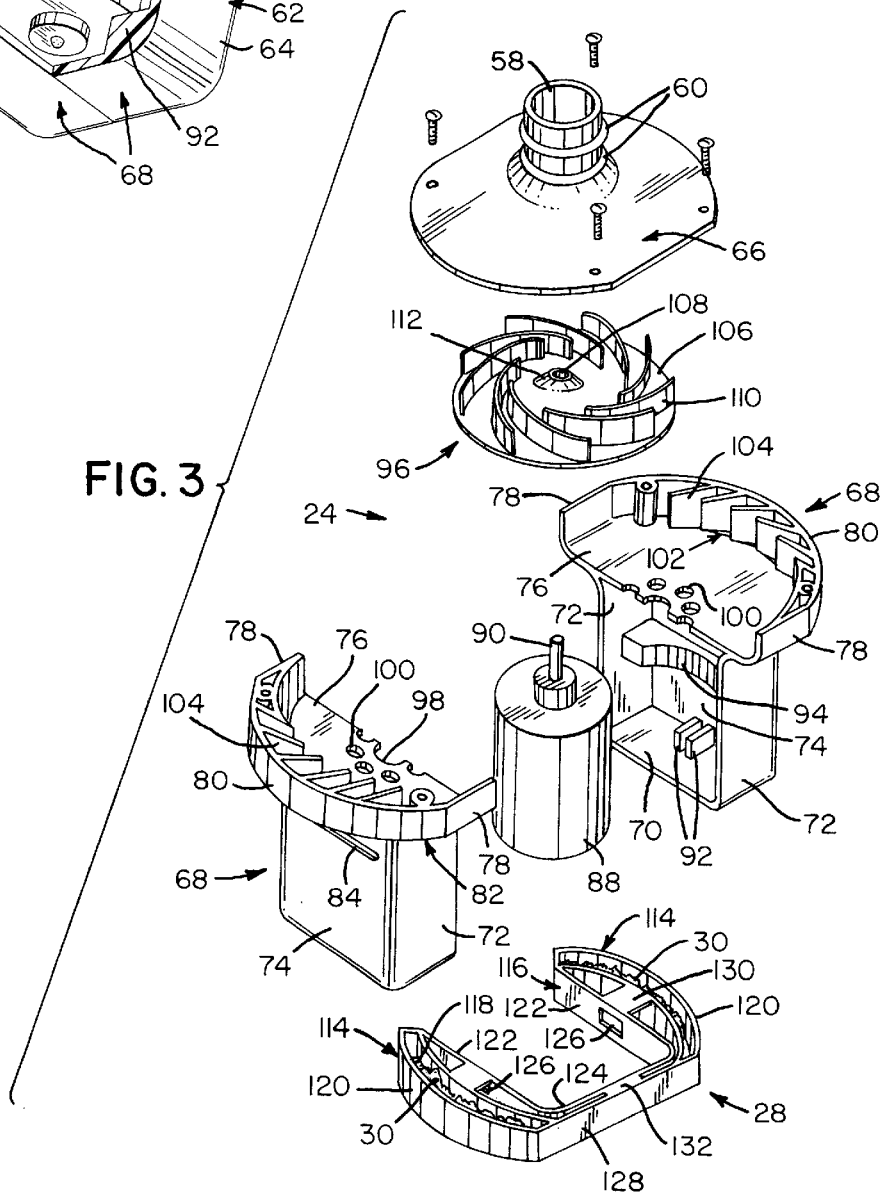
FIG. 3 is an exploded perspective view of the deodorizer of FIG. 2.
Figure 4:
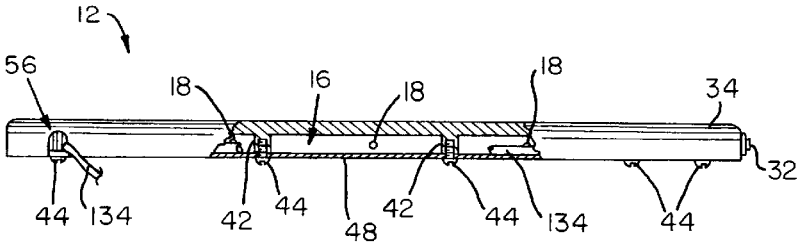
FIG. 4 is a side view of the toilet seat of the toilet-ventilating device with portions broken away to reveal details thereof.
Figure 5:
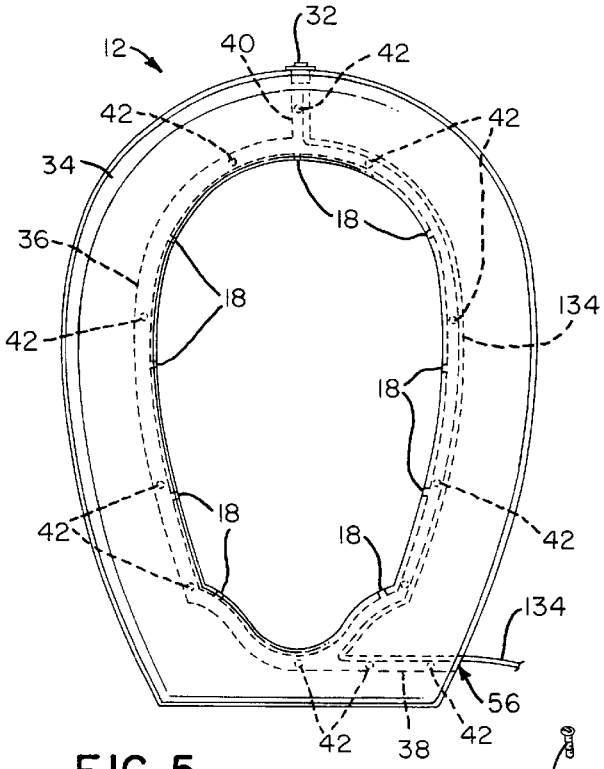
FIG. 5 is a top view of the toilet seat of FIG. 4.
Figure 6:
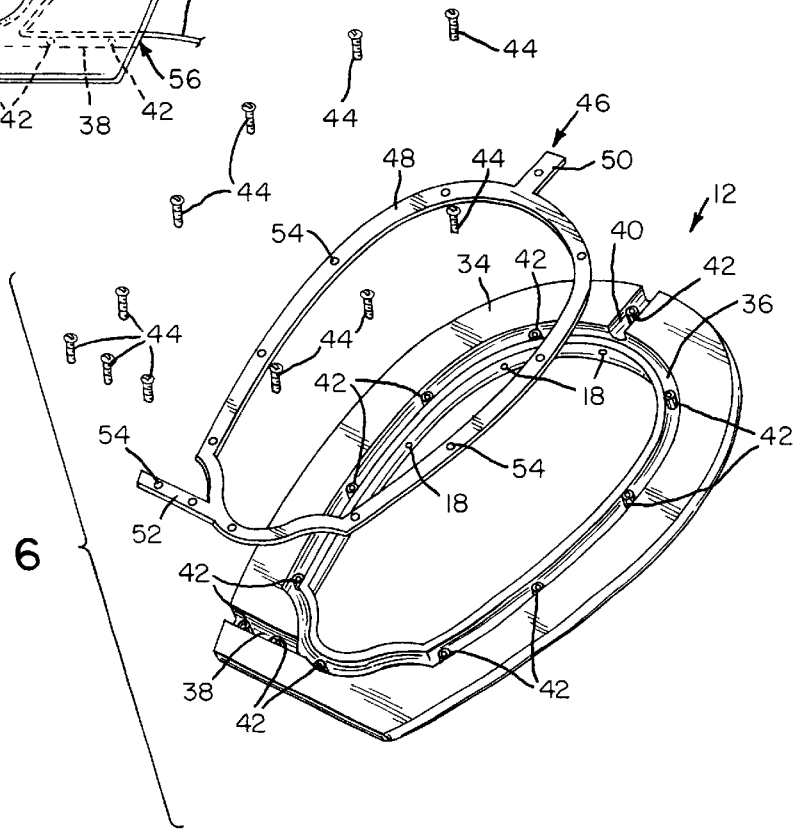
FIG. 6 is an exploded perspective view of the toilet seat.

Referring now to the FIGS., a toilet-ventilating device in accordance with the present invention is shown at 10. Device 10 includes a toilet seat 12 for mounting on a toilet 14. Seat 12 has an internal passageway 16 with a number of access ports 18 allowing air in the bowl 20 of toilet 14 to enter passageway 16. A flexible hose 22 extends from seat 12 and connects passageway 16 to a deodorizer 24. Deodorizer 24 has a blower 26 and a cartridge 28 containing an aromatic substance 30. When energized by means of on/off switch 32 on seat 12, blower 26 draws air from bowl 20 and propels such through cartridge 28 where the air acquires a pleasing aroma before being vented into the space adjacent toilet 14.

Seat 12 comprises a flattened ring 34, the bottom of which is provided with a peripheral groove 36. Access ports 18 extend radially inward from groove 36 and open through the inner surface of ring 34. An air outlet channel 38, on the other hand, extends from the rear of groove 36 and opens through one side of ring 34. Also, a wiring channel 40 connects the front of groove 36 to the front of ring 34.

A number of screw bosses 42 extend downwardly from the tops of groove 36 and channels 38 and 40. Each boss 42 is an internally threaded cylinder for threadably receiving a screw 44. Each boss 42 is integrally formed with the remainder of ring 34 and extends partially toward the bottom of groove 36, channel 38 or channel 40 so as to provide a recess for receiving a close-fitting cover plate 46.

Cover plate 46 closes the bottoms of groove 36 and channels 38 and 40 to make an airtight passageway 16 in ring 34. Cover plate 46 includes a hoop 48 having a wiring tab 50 extending forwardly from the front of hoop 48 and an outlet tab 52 extending laterally from the rear of hoop 48. As shown, hoop 48 is sized to fit snugly within peripheral groove 36 whereas tabs 50 and 52 are sized and positioned to fit snugly within wiring channel 40 and outlet channel 38. Perforations as at 54 in hoop 54 and tabs 50 and 52 permit screws 44 to be threaded into bosses 42 thereby fastening cover plate 46 to ring 34.

Hose 22 is a flexible hollow tube formed of any suitable material and provided with any convenient dimensions.

Preferably, one end of hose 22 is tapered and configured for snug insertion into the open end 56 of outlet channel 38. The other end of hose 22 is sized to snugly receive the tubular inlet 58 of deodorizer 24. A pair of circumferential indentations (not shown) can be provided about the inner wall of hose 22 to snugly receive the pair of circumferential ribs 60 provided about inlet 58 and assure a strong grip on inlet 58.

Deodorizer 24 includes a housing 62 for blower 26 having a base portion 64 that is closed by lid 66. Base portion 64 includes two, like parts 68 that are cemented to one another side by side. Each part 68 includes a rectangular, bottom wall 70 having a first pair of side walls 72 and a first back wall 74 extending upwardly from the opposed sides and back of bottom wall 70. A top wall 76 connects the respective tops of walls 72 and 74 together and is parallel to bottom wall 70. As shown, top wall 76 projects outwardly from walls 72 and 74. A second pair of side walls 78 and a second back wall 80 extends upwardly from the opposed sides and back of top wall 76. Thus, the outwardly projecting portion of top wall 76 defines a shoulder 82 connecting walls 72 and 74 to walls 78 and 80.

Positioned beneath each shoulder 82 and projecting from back wall 74 is a guide rail 84 for engaging and supporting the bottom of cartridge 28. Preferably, each guide rail 84 is parallel to its adjacent shoulder 82 and extends from one side of a back wall 74 to the other side thereof. Positioned between each guide rail 84 and shoulder 82 is an outwardly projecting pin 86 for engaging a side of cartridge 28. Pin 86 is tapered along its length so that its front end projects farther from back wall 74 than its back end to make engagement with cartridge 28 easy.

Walls 70, 72 and 74 define a space for receiving blower motor 88 that may be energized to rotate drive shaft 90 by either an ac or a dc power source (not shown). A pair of posts 92 extends upwardly from each bottom wall 70 to hold motor 88 at a distance from bottom wall 70. Similarly, a brace 94 extends outwardly from the midpoint of each back wall 74 opposite guide rail 84 to space motor from walls 74. Of course, posts 92 and braces 94 ensure that motor 88 does not wobble and that air can circulate around such.

Walls 76, 78 and 80 define a space for receiving a blower fan 96. A primary cutout 98 is provided in the front of each top wall 76 for the passage of drive shaft 90. A number of secondary cutouts 100 in each top wall 76 and adjacent to primary cutout 98 permit cooling air to circulate to motor 88 in the space enclosed by walls 70–76. A number of outlet openings 102 are provided in each shoulder 82 adjacent back wall 80. A number of fins 104 separate openings 102 from one another and join top and back walls 76 and 80. Preferably, each of fins 104 is oriented at an acute angle relative to each back wall 80 so that air can be guided from fan 96 into openings 102 with maximum efficiency. Thus, each top wall 76 and the parts attached directly to it serve to direct airflow to minimize pressure losses associated with fan 96 and to isolate motor 88 from exposure to dust, dirt and aromatic substances in the air flowing from fan 96.

Fan 96 is secured for Rotation to drive shaft 90 of motor 88. Fan 96 includes a disk 106 having a hole 108 at its center for snugly receiving drive shaft 90. Extending upwardly from disk 106 are a number of fan blades 110. Each of blades 110 arcs outwardly from the central portion of disk 106 to the periphery of disk 106 to impel air past fins 104 and into openings 102 when rotated. As shown, the central portion of disk 106 includes a bulge 112 beneath which a number of cooling blades (not shown) may descend to draw air through cutouts 98 and 100 to prevent the overheating of motor 88.

Cartridge 28 includes a pair of baskets 114 for holding aromatic substance 30 secured to opposite sides of a retaining clip 116 for engaging base portion 64 of housing 62. Each basket 114 includes an openwork bottom wall 118 from which a peripheral side wall 120 extends upwardly to slidably engage shoulder 84 and enclose openings 102 so that all air impelled by fan 96 through openings 102 is forced through baskets 114 and out bottom wall 118. Clip 116, however, is U-shaped with two legs 122 connected together by a crosspiece 124. An aperture 126 in the center of each of the legs 122 snugly, yet releasably, receives one of the pins 86 extending from base portion 64 when cartridge 28 is mounted on housing 62. Crosspiece 124 is reinforced by a doubler 128 positioned parallel to crosspiece 124 that connects baskets 114 together. Additional reinforcement is offered by spars 130 and 132 connect the centers of legs 122 and crosspiece 124 to baskets 114 and doubler 128, respectively.

Aromatic substance 30 may include a variety of products. By way of example only, substance 30 may be a finely divided solid capable of sublimating over time when exposed to air. Also, substance 30 could be a porous sponge or an air-permeable pad formed of a dense mat of natural or synthetic fibers to which has been applied one or more essential or botanical oils or other aromatic compounds capable of evaporating in air. The aromatic compounds may be distilled extracts of leaves, flowers, branches, barks, roots, or like natural or synthetic materials. Since the tops of baskets 114 in cartridge 28 are open, a user can add to or change substance 30 whenever the substance has been depleted or a new aroma is desired.

Electrical power is supplied to motor 88 from a source located within housing 62 or elsewhere through a cable 134 routed through: hose 22, air outlet channel 38, peripheral groove 36 and wiring channel 40 to switch 32 mounted at the front of seat 12. A user can selectively energize motor 88 to drive fan 96 by momentarily pressing and releasing switch 32. After a predetermined period of time, perhaps a few minutes, switch 32 automatically opens the circuit between the power source and motor 88 to deenergize such and conserve power.

Use of toilet-ventilating device 10 is straightforward. To clean air flowing from toilet bowl 20, a user merely needs to press switch 32 to energize blower 26—a task that can be accomplished while seated on seat 12. Energized blower 26 draws air into ports 18 and, then, through hose 22 to deodorizer 24. Air enters deodorizer 24 via inlet 58 and is propelled by fan 96 through openings 102 into cartridge 28. Next, under continued operation of blower 26, air passes through baskets 114 where it aromatic substance 30 imparts a pleasant scent to air. The now-treated air exits baskets 114 through openwork bottom walls 118 and fills the area adjacent toilet 14 with a pleasant aroma. Switch 32 deenergizes blower 26 after a set period of time to conserve energy.

Should it be desired to change aromatic substance 30 with a different one, cartridge 28 can be removed from deodorizer housing 62. Such removal is accomplished by grasping baskets 114 and lightly pulling such away from one another. Under this stress, retaining clip 116 will deform so that pin 86 on housing 62 is clear of aperture 126. Then, legs 122 can be slid laterally along guide rails 84 so that cartridge is free of housing. Baskets 114 can now be emptied (if necessary) and a new aromatic substance 30. Replacement of cartridge 28 on housing 62 is made by reversing the steps just delineated. Device 10 is now ready for reuse.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A toilet-ventilating device, comprising:

a toilet seat having an internal passageway with a number of access ports;

a hose extending from said toilet seat and communicating with said internal passageway;

a deodorizer connected to said hose, said deodorizer including:

a housing having an inlet opening and an outlet opening;

a blower positioned within said housing for drawing air from said internal passageway into said housing through said inlet opening and from said housing through said outlet opening; and, an air-permeable cartridge containing an aromatic substance clipped to the exterior of said housing and covering said outlet opening.

2. The toilet-ventilating device according to claim 1 wherein said toilet seat includes:

a flattened ring;

a peripheral groove in the bottom of said ring;

a plurality of access ports extending from said groove through which air can enter said groove;

an air outlet channel extending from the rear of said groove;

a plurality of screw bosses projecting respectively into said groove and said outlet channel, each of said screw bosses being an internally threaded cylinder;

a cover plate abutting said flattened ring and closing said groove and said outlet channel; and, a plurality of threaded fasteners releasably securing said cover plate to said plurality of screw bosses.

3. The toilet-ventilating device according to claim 2 further comprising:

a wiring channel extending from said groove to the front of said flattened ring; and, a switch for selectively energizing said blower mounted in the front of said wiring channel.

4. The toilet-ventilating device according to claim 1 wherein said deodorizer includes:

a pair of shoulders projecting from opposite sides of said housing, each of said shoulders having at least one said outlet opening therein;

a pair of guide rails each projecting from said housing adjacent to a respective one of said shoulders; and, a pair of pins projecting from said housing, each of said pins being positioned between one of said shoulders and one of said guide rails.

5. The toilet-ventilating device according to claim 4 wherein said cartridge includes:

a retaining clip for engaging opposite sides of said housing, said clip having a pair of legs joined together by a crosspiece, each of said legs being adapted for sliding engagement with said housing between said shoulders and said guide rails, each of said legs also having an aperture for receiving one of said pins; and, a pair of baskets for holding an aromatic substance secured to opposite sides of said retaining clip, each of said baskets includes an openwork bottom wall and a peripheral side wall extending upwardly from said openwork bottom wall, the top of each said peripheral side wall be adapted to slidably engage one said shoulder and enclose an adjacent one of said openings so that all air impelled by blower is forced through said baskets and out said openwork bottom walls.

6. A toilet-ventilating device, comprising:

a toilet seat having an internal passageway with a number of access ports;

a hose extending from said toilet seat and communicating with said internal passageway;

a deodorizer connected to said hose, said deodorizer including:

a housing having an inlet opening;

a pair of shoulders projecting from opposite sides of said housing, each of said shoulders having at least one said outlet opening therein, each said outlet opening being in fluid communication with said inlet opening;

a pair of guide rails each projecting from said housing adjacent to a respective one of said shoulders; and, a pair of pins projecting from said housing, each of said pins being positioned between one of said shoulders and one of said guide rails;

a blower positioned within said housing for moving air from said internal passageway into said housing through said inlet opening and from said housing through said outlet openings; and, an air-permeable cartridge containing an aromatic substance clipped to the exterior of said housing and covering said outlet opening.

7. The toilet-ventilating device according to claim 6 wherein said cartridge includes:

a retaining clip for engaging opposite sides of said housing, said clip having a pair of legs joined together by a crosspiece, each of said legs being adapted for sliding engagement with said housing between said shoulders and said guide rails, each of said legs also having an aperture for receiving one of said pins; and, a pair of baskets for holding an aromatic substance secured to opposite sides of said retaining clip, each of said baskets includes an openwork bottom wall and a peripheral side wall extending upwardly from said openwork bottom wall, the top of each said peripheral side wall be adapted to slidably engage one said shoulder and enclose an adjacent one of said openings so that all air impelled by blower is forced through said baskets and out said openwork bottom walls.

* * * * *